United States Patent [19]

Redman

[11] Patent Number: 4,741,081

[45] Date of Patent: May 3, 1988

[54] METHOD AND APPARATUS FOR MAKING T-TUBE FITTINGS

[75] Inventor: Robert J. Redman, Indian River, Mich.

[73] Assignee: Tube Fab of Afton Corporation, Afton, Mich.

[21] Appl. No.: 6,808

[22] Filed: Jan. 27, 1987

[51] Int. Cl.[4] ..... B21D 53/00

[52] U.S. Cl. ..... 29/157 T; 29/33 D; 29/33 J; 29/33 T; 29/525; 29/557; 29/792

[58] Field of Search ..... 29/157 T, 33 J, 33 T, 29/33 D, 792, DIG. 4, 525, 557, 157.4

[56] References Cited

U.S. PATENT DOCUMENTS

| | | | |
|---|---|---|---|
| 1,892,712 | 1/1933 | Taylor | 72/348 |
| 2,149,508 | 3/1939 | Coe | 72/324 |
| 2,297,013 | 9/1942 | Nichols et al. | 29/157 T |
| 2,310,083 | 2/1943 | Holmes et al. | 29/157 T |
| 2,318,707 | 5/1943 | Nichols et al. | 29/157 T |
| 3,064,707 | 11/1962 | Walts | 29/157 T |
| 3,204,481 | 9/1965 | Golden | 74/551.1 |
| 3,406,988 | 10/1968 | Jones | 285/24 |
| 3,451,113 | 6/1969 | Holden | 29/157 T |
| 3,812,698 | 5/1974 | Stock | 29/157 T X |
| 3,822,053 | 7/1974 | Daily | 256/22 |
| 3,848,855 | 11/1974 | Weiland | 256/73 |
| 3,998,376 | 12/1976 | Haines | 228/154 |
| 4,253,224 | 3/1981 | Hickman et al. | 29/157 T |
| 4,370,790 | 2/1983 | Rodaway | 29/157 T |

*Primary Examiner*—Mark Rosenbaum
*Assistant Examiner*—Ronald S. Wallace
*Attorney, Agent, or Firm*—Basile and Hanlon

[57] ABSTRACT

A T-fitting is formed from two precut lengths of tubing of the same, relatively small, inner and outer diameter. One length of tubing is formed with a reduced diameter neck section at one end whose outer diameter is approximately equal to its normal undeformed inner diameter. The second length of tubing is placed in a clamp which is advanced to successive work stations where a sidewall is punched and then drilled through to form a radial hole in one side of a diameter substantially equal to the inner diameter of the tubing. At a subsequent work station, the neck section of the first length of tubing is driven into a force fit into the drilled hole in second length of tubing. The assembled tubing is then removed from the clamp, brazed into a permanent T-tube assembly. The portion of the neck section which projects into the passage of the second length of tubing is then trimmed off by a drilling or reaming operation.

4 Claims, 2 Drawing Sheets

METHOD AND APPARATUS FOR MAKING T-TUBE FITTINGS

BACKGROUND OF THE INVENTION

The present invention is directed to a method and apparatus for the mass production of T-tube fittings, particularly T-tube fittings formed from relatively small diameter metal tubing. These fittings are required in relatively large numbers by the automotive industry to couple flexible hose lines employed in vacuum actuated control systems, windshield washer systems, etc.

While the method and apparatus of the present invention are capable of forming T-tube fittings from tubing of any reasonable diameter, where the fitting is formed from tubing of relatively small diameter, for example, approximately one-eighth of an inch outside diameter, certain problems peculiar to the small size of the tubing arise. Because of the relatively small diameters involved, the margin for error is reduced. The employment of specialized tooling insertable into the interior of the tubes (see Holden U.S. Pat. No. 3,451,113, for example) or the deformation or forming of portions of the tubing into specialized shapes (see U.S. Pat. Nos. Hickman et al 4,253,224, Taylor 1,892,712 or Coe 2,149,508, for example) is greatly restricted, both by the physical dimensions of the tubing and the fact that in the smaller diameter tubing, the ratio of wall thickness to outer diameter is substantially greater than for tubing of larger diameter.

The present invention is especially directed to a method and apparatus for forming T-tube fittings from relatively small diameter tubing at relatively high production rates.

SUMMARY OF THE INVENTION

In accordance with the present invention, a first length of tubing which will constitute the cross bar portion of the T-fitting and a second length of tubing which will constitute the leg of the T-fitting are cut from tubing stock. The two lengths of tubing are of the same original inner and outer diameter. The second length of tubing is then formed at one end with a reduced diameter neck section which may taper slightly from a minimum outer diameter at the end to the point where the neck section merges with the undeformed portion of the tubing.

The first length of tubing is then placed in a clamp on an intermittently rotated turret with the longitudinal axis of the first length of tubing disposed in a horizontal position normal to a radius from the vertical axis of rotation of the turret. The turret is then advanced one rotary step increment to align the clamped first length of tubing with a punch mounted for reciprocatory movement radially of the turret axis. The punch forms a drill guiding indentation in one side of the first length of tubing.

The tubing is then advanced another rotary step increment to align the clamped tubing with a drill reciprocal radially of the tureet axis and operable to move into the indentation and drill a hole through one wall of the tubing. The hole thus drilled is approximately equal to or slightly less than the internal diameter of the tubing.

After the hole is drilled, the turret is advanced a third rotary step increment to align the hole in the first length of tubing with a seating station. The seating station includes a guide passage coaxial with the hole in the wall of the first length of tubing and the second length of tubing is fed into this passage with its neck portion facing the hole. The second length of tubing is then driven forward to seat the neck portion of the second length of tubing axially within the hole in the first length of tubing with a firm force fit. The two lengths of tubing are now initially assembled into a T-fitting.

The initially assembled T-fitting is then removed from the turret and the first and second lengths of tubing are permanently assembled by brazing the two lengths of tubing to each other around the periphery of the hole and neck portion.

The brazed fitting is then taken to a cleanout station where a drill is passed into the passage of the first length of tubing to remove or trim that portion of the neck section which projects into the passage in the first length of tubing and to remove any burrs from that passage. A second drill of a diameter approximately equal to the internal diameter of the reduced neck section of the second length of tubing is then passed through that tube to complete the deburring operation.

Other objects and features of the invention will become apparent by reference to the following specification and to the drawings.

IN THE DRAWINGS

DESCRIPTION OF THE PREFERRED EMBODIMENT

Figure 1:
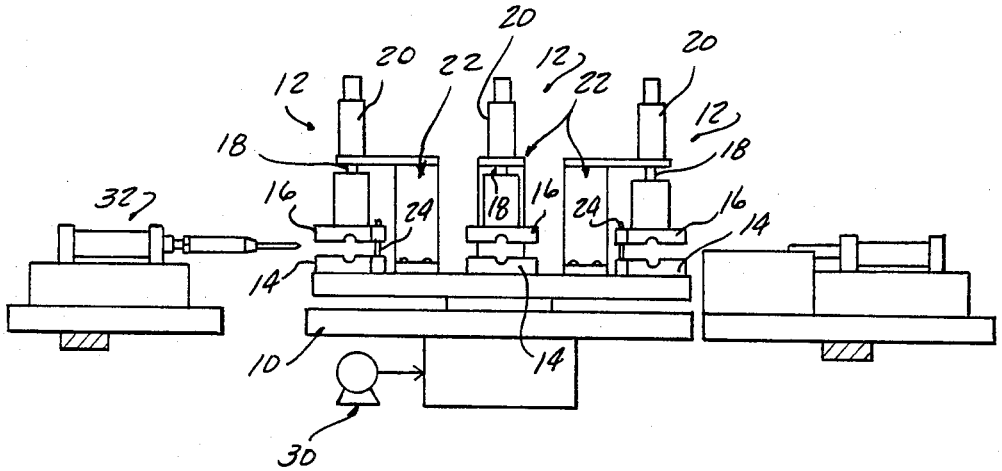
FIG. 1 is a side elevational view, partially schematic, and with certain parts omitted, of an apparatus embodying the present invention.
Figure 2:
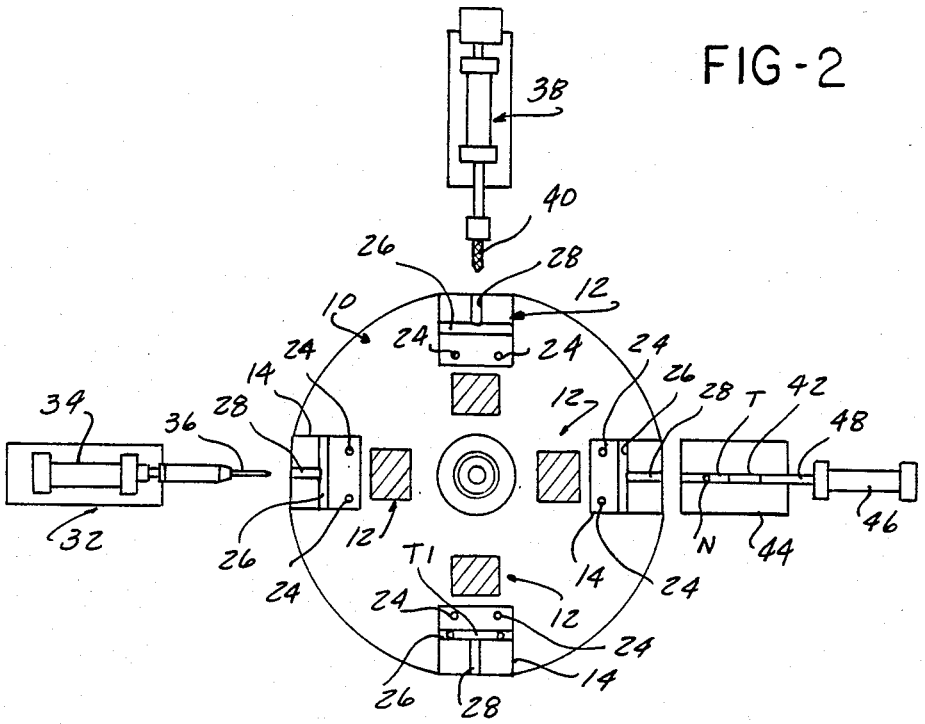
FIG. 2 is a top plan view, again of a schematic nature, with certain parts omitted or shown in section.

Referring first to FIGS. 1 and 2, an apparatus embodying the present invention is schematically illustrated with various components omitted for the sake of clarity. The apparatus includes a turret or rotary turntable designated generally 10 which is mounted for rotation about a vertical axis. Four clamp assemblies of like construction, each designated generally 12, are mounted upon turret 10 in symmetrically spaced relationship about the turret axis as best seen in the plan view of FIG. 2. Each clamp assembly 12 includes a lower clamp member 14 which is fixedly mounted upon turret 10 and an opposed vertically reciprocable upper clamp member 16 coupled to a piston rod 18 of a pneumatic motor 20 whose cylinder is fixedly supported upon turret 10 by a suitable bracket designated generally 22 (FIG. 1). Guide rods such as 24 are fixed to and project upwardly from each lower clamp member 14 to be slidably received in bores in the respective upper clamp members 16 to guide the upper clamp member in vertical movement relative to its opposed lower clamp member 14.

Figure 3:
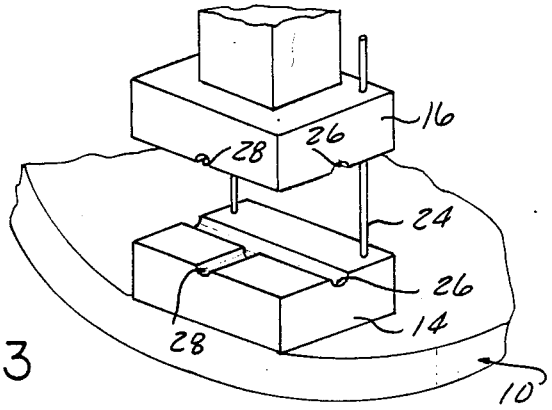
FIG. 3 is a perspective view showing a portion of the clamp assembly of the apparatus of FIG. 1.
Figure 4:
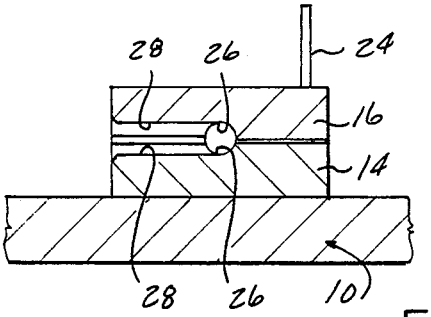
FIG. 4 is a cross-sectional view, taken in a vertical plane through a portion of the clamp section shown in FIG. 3; and FIGS. *5a–5e* are perspective views of tubing lengths at various stages in the assembly process of the present invention.

The opposed faces of the upper and lower clamp members 14 and 16 are formed with semi-cylindrical grooves 26, 28 which, as best seen in FIGS. 2 and 3 intersect to form a T-shaped recess in each clamp member face. The grooves 26 in the upper and lower clamp member are dimensioned in correspondence to the outer diameter of a length of tubing to be handled by the apparatus so that when the clamp members 14 and 16 are closed, as shown in FIG. 4, a piece of tubing is fixedly and tightly clamped within the passage defined by the opposed grooves 26 in the upper and lower clamp members. The diameter of the intersecting grooves 28 in the clamp members 14 and 16 slightly larger because, as will be described below, the passage within the closed die assembly as shown in FIG. 4 which is defined by the grooves 28 will slidably guide a length of tubing. As best seen in FIGS. 2 and 3, the grooves 28 in the various die members extend radially of the axis of rotation of turret 10, and the grooves 26 extend perpendicular to a radius from the axis of rotation of the turret; the longitudinal axes of all grooves 26 and 28 lying in a common horizontal plane.

Turret 10 is driven in step-by-step rotation in 90 degree angular increments by a suitable drive motor schematically illustrated at 30 in FIG. 1. The direction of rotation of turret 10 is clockwise as viewed in FIG. 2.

Referring now particularly to FIG. 2, it is seen that the four clamp assemblies 12 are located upon the turret at what will be referred to as the 12 o'clock, 3 o'clock, 6 o'clock, and 9 o'clock positions about the turret axis.

Each of these four positions of the clamp assemblies aligns the clamp assembly with a work station. At the 6 o'clock position, as viewed in FIG. 2, an assembled T-fitting is manually removed or ejected from the opened clamp assembly and a length of tubing T1 is manually loaded into the groove 26 of the lower clamp member 14. This location will be referred to as the loading-ejection station. The length of tubing T1 which is placed in groove 26 at this time has previously been cut to length and had its ends appropriately champferred. After this length of tubing T1 has been placed within the groove 26 in the lower clamp member 14, the machine operator manually actuates a suitable control system, not shown, which closes the clamp assembly 12 at the loading-ejection station and rotates turret 10 in a clockwise 90 degree rotary step increment to advance the clamp assembly 12, holding the manually emplaced length of tubing T1, to the 9 o'clock position as viewed in FIG. 2. As described above, upon closing of the clamp, the length of tubing T1 is firmly clamped within the recess defined by the opposed grooves 26 of the upper and lower clamp members. The 90 degree rotation of the turret advances the next following clamp assembly 12 to the loading-ejection station at the 6 o'clock position in FIG. 2. Upon arrival at the loading station, this latter clamp assembly is opened and another length of tubing T1 is loaded as described before.

Figure 5A:
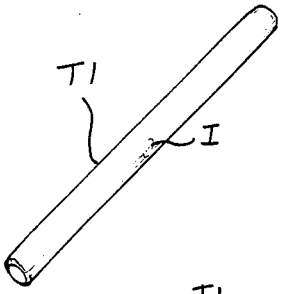

A punch assembly designated genreally 32 is mounted upon a fixed frame in radial alignment with the clamp assembly 12 located at the 9 o'clock position in FIG. 2. The punch assembly includes a pneumatic motor 34 whose piston rod carries a punch 36 mounted for horizontal movement radially of the axis of rotation of turret 10. Upon the arrival of a clamp assembly 12 at the 9 o'clock position of FIG. 2, the control system automatically actuates motor 34 to drive its punch 36 axially through the passage defined by the grooves 28 of the opposed closed clamping assembly member 14, 16 to form a drill guiding indentation I (see FIG. 5*a*) in the sidewall of the clamped length of tubing T1. The punch 36 is then automatically withdrawn to the retracted position shown in FIG. 2.

By this time the operator has loaded a second length of tubing T1 into the opened clamp assembly at the loading-ejection station and, when this last length of tubing has been so loaded, the operator manually triggers the control system to advance the turret another 90 degree clockwise step of rotation. This brings the first loaded clamp assembly 12 to the 12 o'clock position shown in FIG. 2.

Figure 5B:
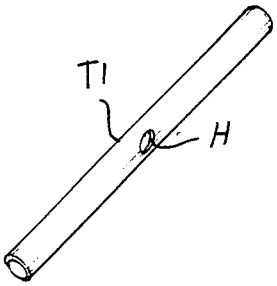
Figure 5C:
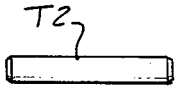

A power driven rotary drill designated generally 38 is mounted upon a fixed frame, with its drill bit 40 aligned with the grooves 28 of the clamp assembly located at the 12 o'clock position of FIG. 2. The drill bit 40 is driven in continuous rotation and may be reciprocated radially of the turret axis from the retracted position shown in FIG. 2 inwardly through the passage 28 to a distance sufficient to engage the drill guiding indentation formed at the previous station in the tubing T1 clamped in grooves 26, and to drill a hole H (see FIG. 5*b*) through one sidewall of that tubing. The drill bit is then retracted to its original position. The diameter of the drill bit is chosen to be substantially equal to the inner diameter of the length of tubing T1 clamped in the clamp assembly.

Simultaneously with the drilling of a hole through the tubing at the 12 o'clock position, the punch 36 at the preceding station forms a drill guiding indentation I in the tubing held in the clamp assembly at that station. The operator loads a third piece of tubing T1 into the clamp assembly at the loading-ejection station, and operates the control system to advance the turret through another 90 degree clockwise step of rotation. This brings the clamp member 12, holding the drilled length of tubing T1, to the 3 o'clock position of FIG. 2, thus placing the grooves 28 in that clamp assembly in alignment with a groove or slot 42 in a guide block 44 mounted upon a fixed frame, not shown.

Figure 5D:
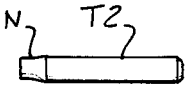
Figure 5E:
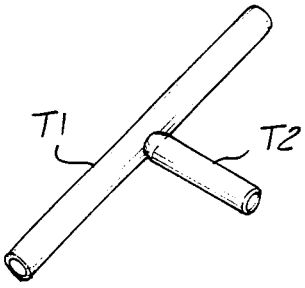

At this time, a second length of tubing T2, more clearly shown in FIG. 5*d*, is located in groove 42 to be axially aligned with passage 28. The length of tubing T2, as best seen in FIG. 5*d*, is formed with a reduced diameter neck section N at one end which may taper in its extent from the end of tube T2 to the normal or undeformed diameter of the tubing. Tubes T1 and T2 are originally cut from the same tubing stock and the reduction in diameter of the neck portion N of the tubing length T2 is such that the diameter of the neck section N at the extreme end of the tube is equal to or slightly less than the normal undeformed inside diameter of the tubing T1, T2. As stated above, the diameter of the hole drilled in the tubing section T1 by drill bit 40 is equal to or slightly less than the normal inside diameter of the tubing.

Piston rod 48 of a pneumatic motor 46 is located to reciprocate within the groove 42 in guide block 44, and is operable to drive the length of tubing T2 inwardly through passage 28 in the opposed clamp assembly 12 and to drive the neck portion N of tubing T2 forceably into the hole H, previously formed in the sidewall of tube T1 to force-fit the tube T2 into the hole H in the tube T1 thus forming a T-shaped assembly with the two tubes.

Upon the next subsequent rotary step of turret 10, the assembled tubes T1, T2 are advanced to the loading-ejection station and upon opening of their clamp assembly are ejected or manually removed from the clamp by the machine operator.

Subsequent to their removal from the apparatus of FIGS. 1 and 2, the mechanically assembled T fittings are taken to a brazing station where the tubes T1 and T2 are permanently assembled by brazing the tubes together at the juncture of the tubes T1 and T2.

After the brazing operation, the passage through the tube T1 is drilled out to the inner diameter of tube T1 to finish off the end of neck portion N of tube T2 which projects into the passage through tube T1 and to remove any burrs. Preferably, a drill is similarly passed through tube T2; this latter drill being of a diameter equal to the normal reduced inner diameter of the neck section N.

While an exemplary embodiment of the method and apparatus have been described in detail, it will be apparent to those skilled in the art that the embodiment described may be modified. Therefore, the foregoing description is to be considered exemplary rather than limiting, and the true scope of the invention is that defined in the following claims.

What is claimed is:

1. The method of making a T fitting from first and second lengths of tubing of like inside and outside diameters comprising the steps of (1) forming a reduced diameter neck section at one end of said first length of tubing;

(2) drilling a hole radially through the wall of said second length of tubing intermediate its ends, said hole being of a diameter such as to receive the reduced diameter neck section of said first length of tubing with a force fit, (3) forcing the reduced diameter neck section of said first length of tubing into said hole in said second length of tubing to seat said neck section therein with said first length of tubing projecting radially from said second length of tubing, (4) connecting the neck portion of said first length of tubing to said second length of tubing around the periphery of said hole, and (5) removing that portion of the neck section which projects into the interior of said second length of tubing.

2. The method defined in claim 1 wherein the step of removing comprises the step of passing a rotating drill leaving a diameter substantially equal to the inside diameter of said second length of tubing axially from one end of said second length of tubing through said second length of tubing to a location beyond said hole to trim the end of said neck section flush with the interior wall of said second length of tubing.

3. The invention defined in claim 2 further comprising the step of (6) passing a rotating drill having a diameter substantially equal to the inner diameter of said reduced neck section through said neck section, of said first length of tubing, into the interior of said second length of tubing.

4. Apparatus for assembling a T tube fitting comprising a turret mounted for rotation about a vertical axis, a plurality of like tubing clamping means mounted on said turret at uniformly spaced locations about said axis, said tube clamping means being operable to releasably clamp a first length of tubing with the longitudinal axis of the first length of tubing perpendicularly intersecting a radius from said vertical axis, means for driving said turret in step-by-step rotation about said axis to advance said clamping means sequentially to each of a plurality of work stations disposed about the periphery of said turret, means at a first of said work stations for forming a drill guiding indentation in the sidewall of a first length of tubing clamped in one of said tube clamping means, drill means at a second of said work stations for advancing a drill into a drill guiding indentation in a first length of tubing clamped in one of said tube clamping means and drilling a radial bore through the sidewall of the last mentioned first length of tubing, and means at a third of said work stations for longitudinally advancing a second length of tubing axially along a path coaxial with the radial bore in a first length of tubing clamped in one of said clamping means until one end of said second length of tubing is seated in a force fitted engagement in said radial bore.

* * * * *